US005890565A

United States Patent [19]

Wang

[11] Patent Number: 5,890,565

[45] Date of Patent: Apr. 6, 1999

[54] ELEVATOR EMERGENCY ESCAPE DEVICE

[76] Inventor: chiu nan Wang, No. 50, Alley 97, Lane 354, Sanher Road, Fengyuan City, Taichung County, Taiwan

[21] Appl. No.: 688,343

[22] Filed: Jul. 30, 1996

[51] Int. Cl.[6] ..... B66B 11/08

[52] U.S. Cl. ..... 187/263; 187/350

[58] Field of Search ..... 187/263, 266, 187/314, 350

[56] References Cited

U.S. PATENT DOCUMENTS

| | | | |
|---|---|---|---|
| 2,265,891 | 1/1941 | Bertelsen | 187/263 |
| 4,592,450 | 6/1986 | Schaffer | 187/263 |
| 5,680,911 | 10/1997 | Wang | 187/350 |
| 5,713,433 | 9/1995 | Wang | 187/350 |

*Primary Examiner*—William E. Terrell
*Assistant Examiner*—Mark Deuble
*Attorney, Agent, or Firm*—Pro-Techtor International

[57] ABSTRACT

An elevator emergency escape device provided with a brake fastened to the motor shaft and located in the mechanical control room. An action wheel is mounted on the motor shaft such that the action wheel is engaged with a transmission wheel provided with an action cable. An action rod that regulates the action of the brake is provided with a force applying device including a force output member that regulates the braking action of the brake through the action rod. The release of the braking system enables the elevator cab to be operated manually by pulling the action cable.

23 Claims, 14 Drawing Sheets

ELEVATOR EMERGENCY ESCAPE DEVICE

FIELD OF THE INVENTION

The present invention relates generally to an elevator, and more particular to an emergency escape device of the elevator.

BACKGROUND OF THE INVENTION

The normal operation of an elevator is vulnerable to interruption caused by various factors such as a mechanical failure, a power outage, a fire in the building in which the elevator is located, and so forth. The elevator passengers are therefore equally vulnerable to being trapped in the elevator. The situation can become worse if the elevator is disabled midway between two floors. The existing elevators are generally not equipped with a emergency escape device enabling the trapped passengers to operate the disabled elevator to safety.

SUMMARY OF THE INVENTION

It is therefore the primary objective of the present invention to provide an elevator emergency escape device enabling the passengers of a disabled elevator to operate the elevator to safety. The device comprises a brake which is mounted on the transmission shaft of a motor located in the mechanical control room of an elevator. Mounted coaxially on the motor transmission shaft is an action wheel engageable with a transmission wheel on which an action cable is wound. An action rod is provided with a force applying device which comprises a force output member extending to reach the elevator cab such that the action rod is controlled by the force output member so as to bring about the release of the braking action, thereby enabling the disabled elevator cab to be moved by the action cable to safety.

The brake mounted on the motor transmission shaft is of a drum type. The force output member is a hydraulic (or air) pressure conveying tube, which has one end that is located in the elevator cab such that it is connected with a control cylinder. The pressure conveying tube has another end which is connected with a driven cylinder located in the mechanical control room. The control cylinder, which is located in the elevator cab, is composed of a piston rod which is provided with an operation handle. The piston rod is actuated by the movement of the operation handle so as to regulate the conveying of the hydraulic (or air) pressure to control the action of the piston rod of the driven cylinder. The action rod is then actuated directly or indirectly by the action of the piston rod of the driven cylinder so as to bring about the release of the braking action of the brake.

The force output member may be a force applying cable or chain, which is fastened at one end thereof with a weight located at the bottom of the elevator shaft. The force applying cable or chain is fastened at another end thereof with a member which is located in the mechanical control room and is capable of actuating the action rod to bring about the release of the braking action.

The operation of the device of the present invention is attained by the force output member which is capable of actuating the action rod to bring about the release of the braking action of the brake and is also capable of causing the transmission wheel to engage the action wheel. As a result, the elevator cab can be moved up and down by an action cable wound on the rotary wheel which is linked with the transmission wheel.

The transmission wheel, which is engageable with the action wheel mounted on the motor shaft, is provided with a speed limiting friction wheel for moderating the lifting or descending speed of the elevator.

BRIEF DESCRIPTION OF THE DRAWINGS

FIG. 2-1 shows a schematic view of another embodiment of the force application rod as shows in FIG. 2.

DETAILED DESCRIPTION OF THE EMBODIMENTS

Figure 1:
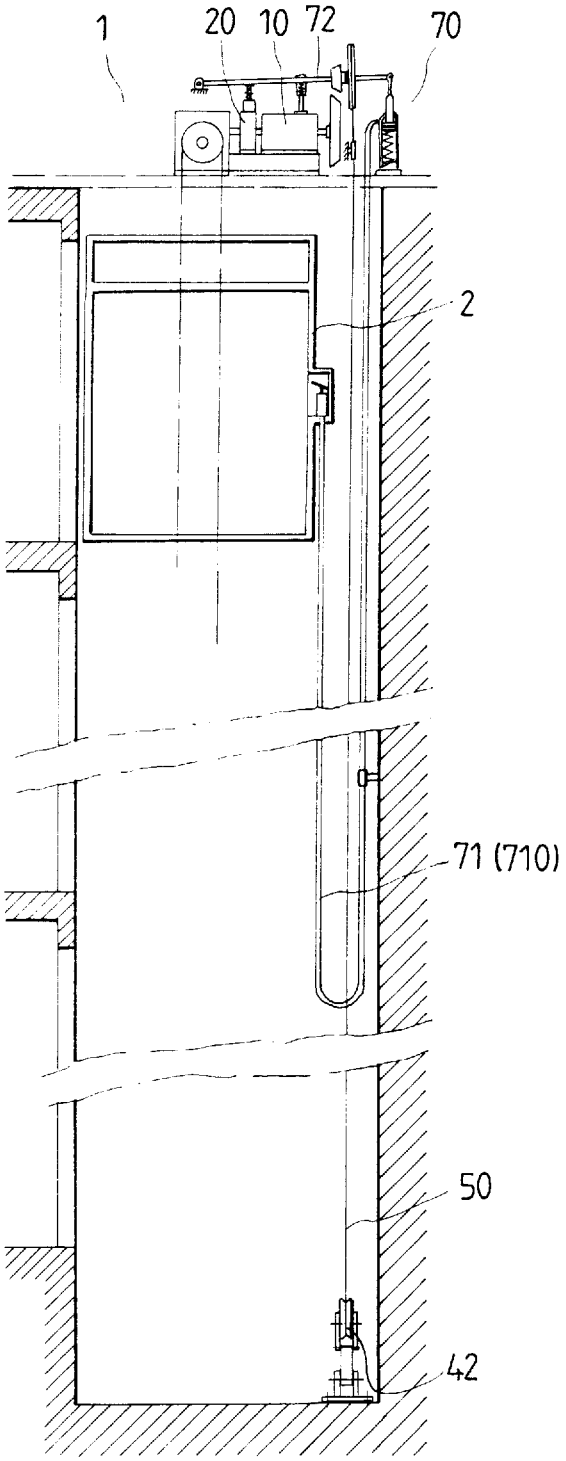
FIG. 1 shows a schematic view of a first preferred embodiment of the present invention.
Figure 2:
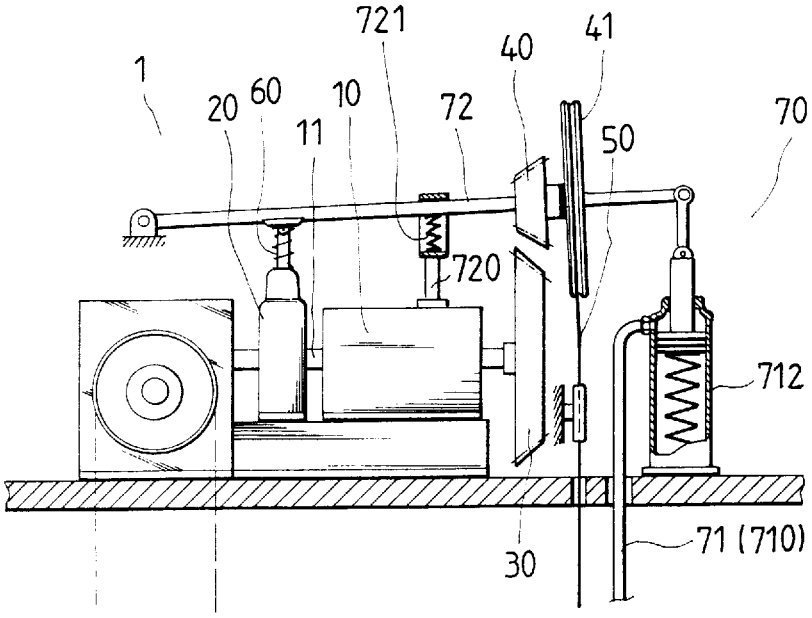
FIG. 2 shows an enlarged view of a portion of the first preferred embodiment of the present invention.
Figure 3:
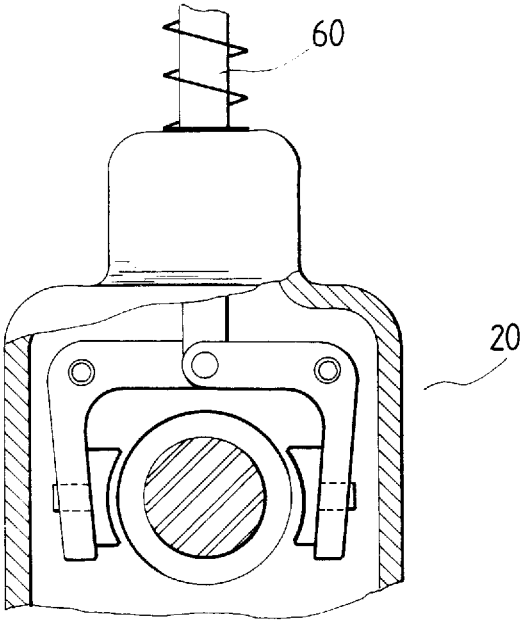
FIG. 3 shows a partial sectional view of a brake of the present invention.
Figures 1, 2:
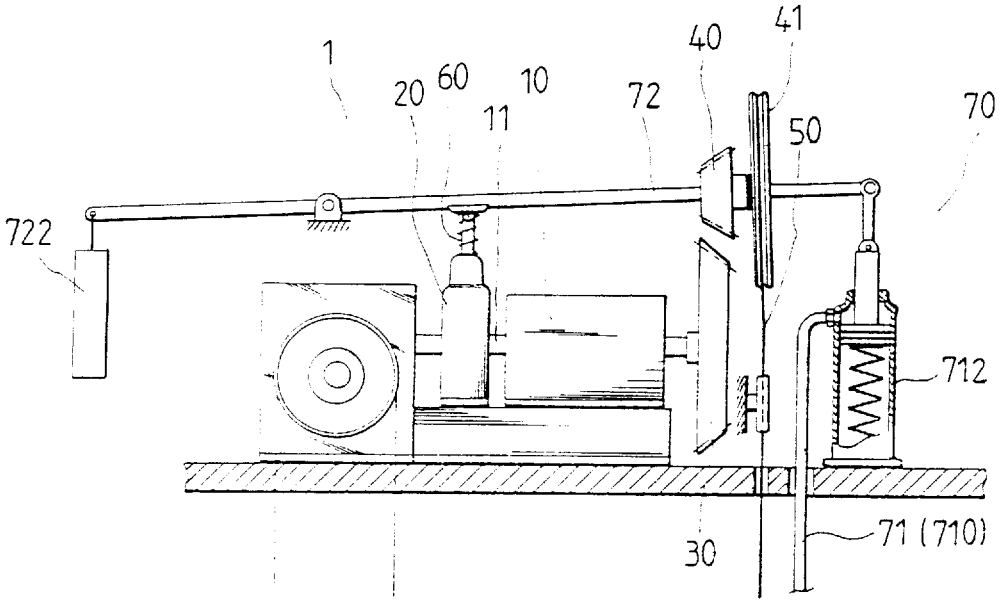

As shown in FIGS. 1 and 2, an elevator emergency escape device embodied in the present invention is composed of a brake 20 which is mounted on a transmission shaft 11 of a motor 10 located in a mechanical control room 1. Mounted coaxially with the brake 20 on the transmission shaft 11 is an action wheel 30 engageable with a transmission wheel 40 which is linked with a rotary wheel 41. An action cable 50 is wound around the rotary wheel 41. An action rod 60 is capable of controlling the brake 20 and is provided at one end thereof with a force applying device 70 which is composed of a force output member 71 extending to reach an elevator cab 2. The action rod 60 is controlled by the force output member 71 to bring about the release of the braking action of the brake 20, thereby enabling the elevator cab 2 to be moved up and down by the action cable 50 to arrive at a safe floor to allow passengers in the cab 2 to escape.

As shown in FIG. 35 the brake 20 mounted on the transmission shaft 11 is of a drum type and is controlled by the action rod 60 capable of an up-and-down motion brought about by an electromagnet. The force output member 71 of the first preferred embodiment of the present invention is a hydraulic (or air) pressure conveying tube 710, which is disposed at one end thereof in a predetermined location of the elevator cab 2 in conjunction with a control tube of the elevator cab 2 such that the hydraulic pressure conveying tube 710 is connected with a hydraulic (or air pressure) control cylinder 711, and that the hydraulic pressure conveying tube 710 is fastened at another end thereof with a driven cylinder 712 located in the mechanical control room 1. The piston rod of the control cylinder 711 is provided with an operation handle 713 capable of actuating the piston rod to bring about the conveying of the hydraulic pressure by the conveying tube 710. The action of the piston rod of the driven cylinder 712 is regulated by the hydraulic pressure conveyed by the conveying tube 710.

The piston rod of the driven cylinder 712 is fastened with one end of a force applying rod 72 of the force applying device 70. The force applying rod 72 is mounted horizontally on the action rod 60. The force applying rod 72 is provided radially with a support rod 720, which is in turn provided with an elastic member 721 urging the force applying rod 72 to swing downwards to press the action rod 60 so as to bring about the release of the braking action.

Figure 5:
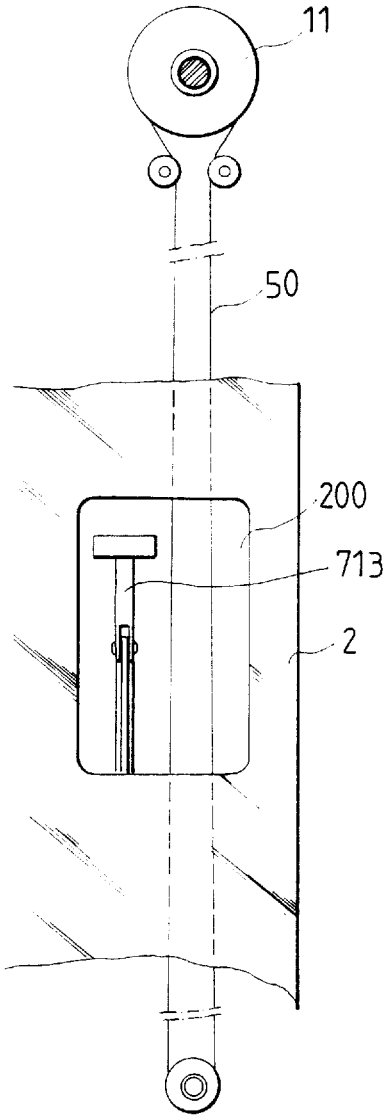
FIG. 5 shows a schematic view of the action cable at work according to the first preferred embodiment of the present invention.
Figure 4:
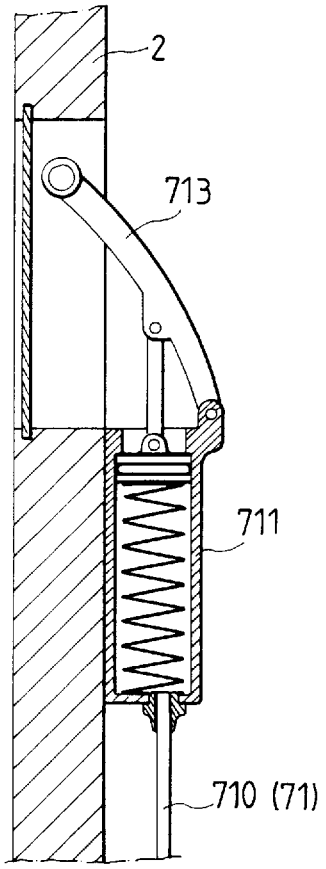
FIG. 4 shows a schematic view of the control cylinder of the elevator cab of the present invention.

The transmission wheel 40 and the rotary wheel 41 are located by the force applying rod 72. An idle wheel 42 is located by another end of the action cable 50 wound on the rotary wheel 41, so as to enable the transmission wheel 40 to engage the action wheel 30 when the force applying rod 72 is caused to swing downwards to bring about the release of the braking action, as shown in FIG. 5. The elevator cab 2 is provided with a window 200 through which the action cable 50 can be reached by a cab passenger. As the action cable 50 is pulled, the shaft 11 of the motor 10 is turned to move the elevator cab 2 to a safe floor to allow the cab passengers to escape.

In case of emergency, the cab passengers have an easy access to the operation handle 713 by breaking or opening the window 200. As soon as the release of the braking action of the brake 20 is brought about, the elevator cab 2 can be moved to a safe floor by pulling manually the action cable 50.

Figure 6:
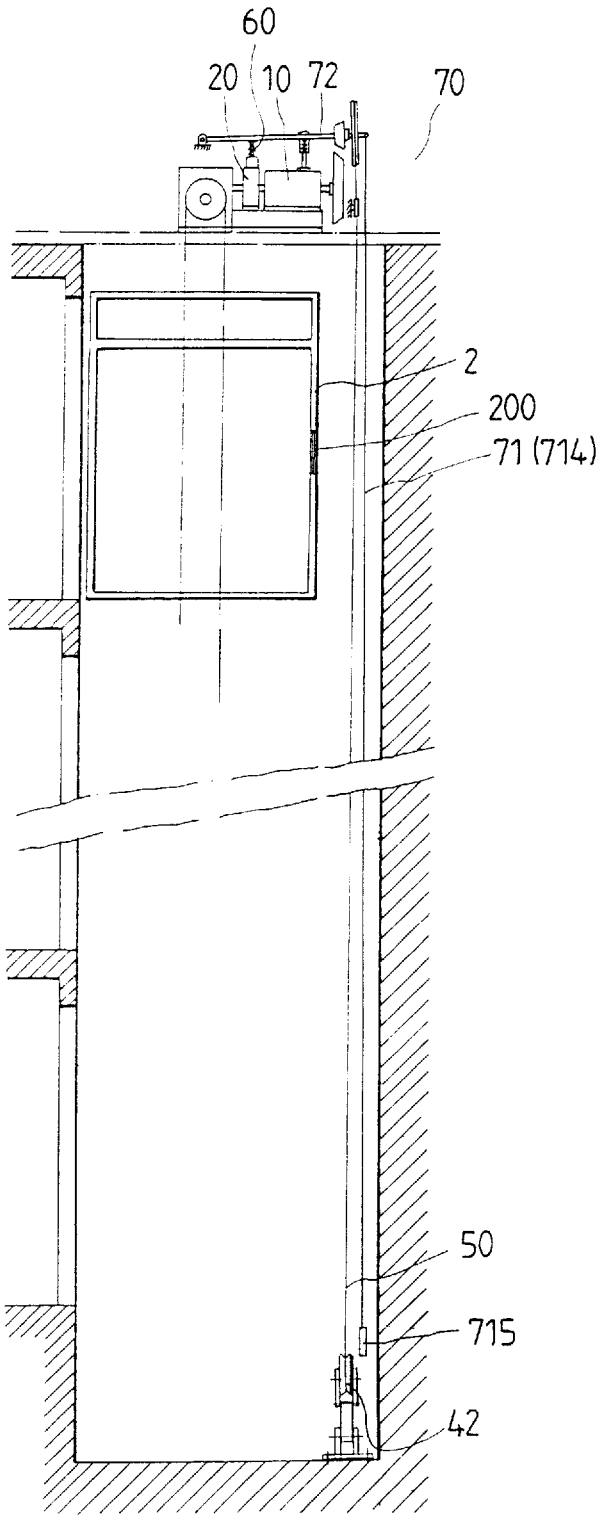
FIG. 6 shows a schematic view of a second preferred embodiment of the present invention.

As shown in FIG. 6, the force output member 71 of the present invention may be a force applying cable 714, which is fastened at one end thereof with a tension weight 715 located at the bottom of the elevator shaft, and is fastened at another end thereof with the force applying rod 72 located in the mechanical control room 1. In case of emergency, the force applying cable 714 can be reached through the window 200. As the force applying cable 714 is pulled manually, the force applying rod 72 is actuated to swing downwards to cause the action rod 60 to bring about the release of the braking action of the brake 20. The elevator cab 2 can be then moved to a safe floor by pulling the action cable 50 manually.

As shown in FIG. 2-1, the force applying rod 72 is provided with a weight 722 capable of causing the force applying rod 72 to swing back to its original position when the force applying rod 72 is not acted on by the force output member 71.

Figure 7:
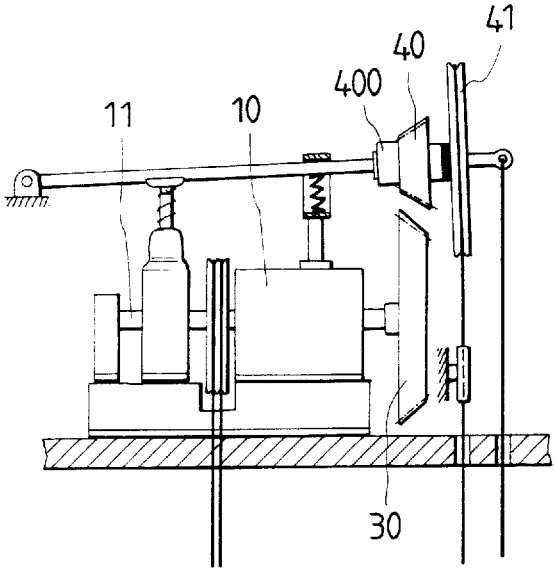
FIG. 7 shows a schematic view of a third preferred embodiment of the present invention.
Figure 8:
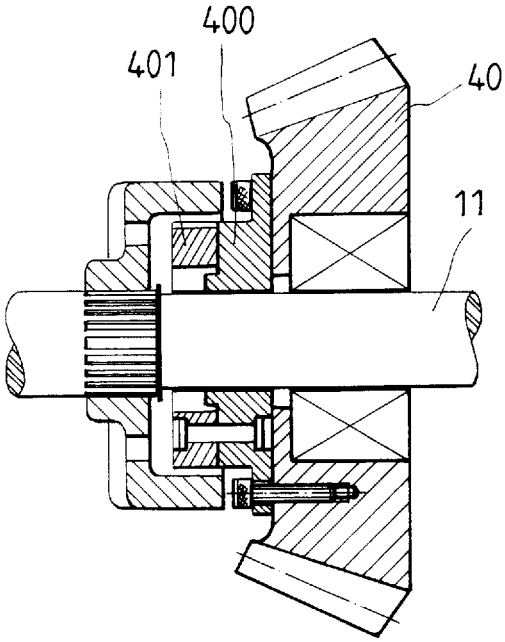
FIG. 8 shows a schematic view of the internal structures of the speed-limiting friction wheel of the third preferred embodiment of the present invention.

As shown in FIG. 7, an action wheel 30 is mounted on the shaft 11 of the motor 10 of the high-speed elevator such that the action wheel 30 is engaged with a transmission wheel 40 which is provided with a speed-limiting friction wheel 400, as shown in FIG. 8. The speed-limiting friction wheel 400 has a centrifugal brake block 401 which is intended for use in decelerating the transmission wheel 40 when the transmission wheel 40 is turning too fast. In other words, when the shaft 11 of the motor 10 is relieved of the braking action, the inertia rising or descending of the elevator cab is brought about. The speed-limiting friction wheel 400 is therefore used to decelerate the shaft 11 of the motor 10 so as to enable the elevator cab to arrive at a safe floor at a slower pace.

Figure 9:
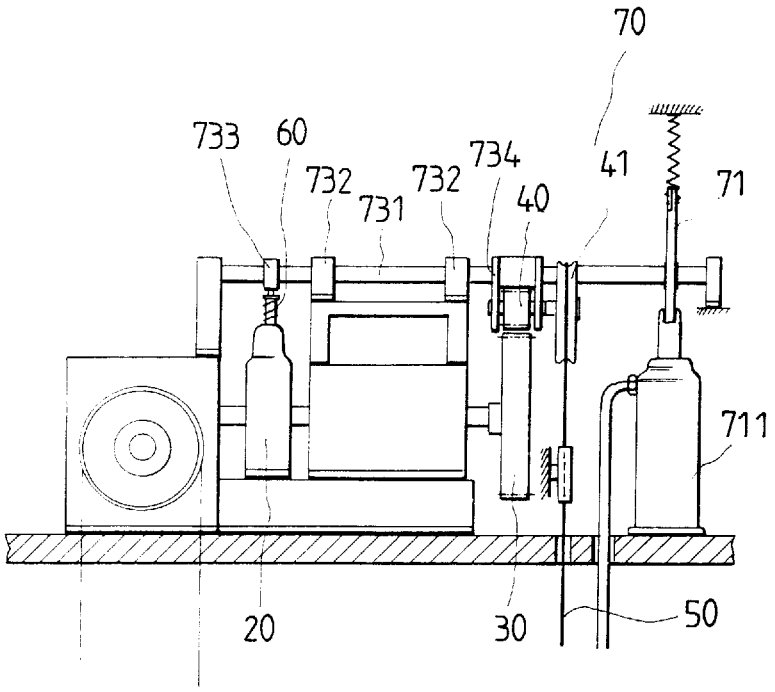
FIG. 9 shows a schematic view of a fourth preferred embodiment of the present invention.
Figure 10:
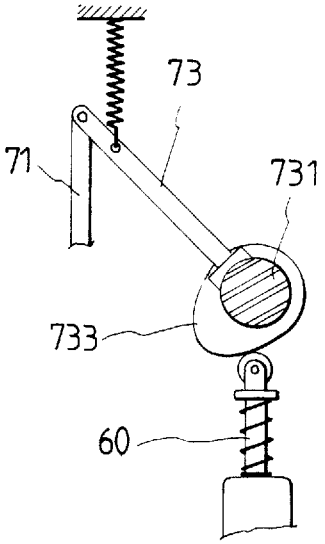
FIG. 10 shows a schematic view of the cam acting on the action rod of the fourth preferred embodiment of the present invention.
Figure 11:
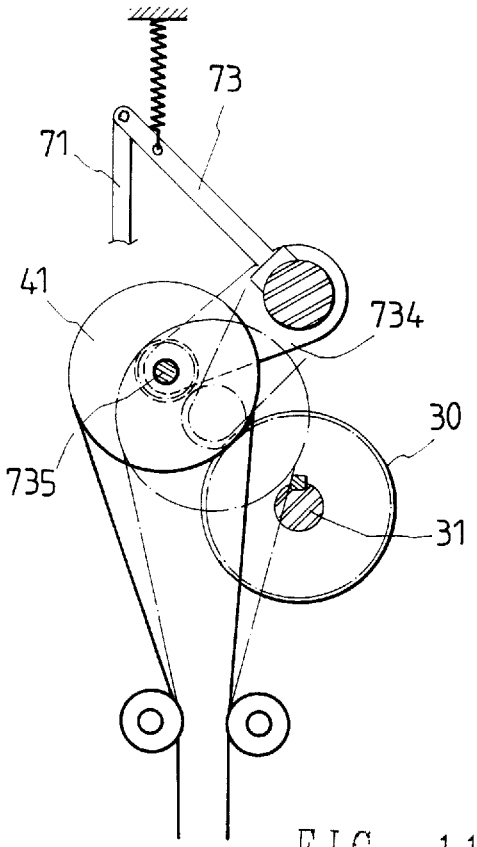
FIG. 11 shows a schematic view of the rotary rod on which the transmission wheel and the rotary wheel are mounted.
Figure 12:
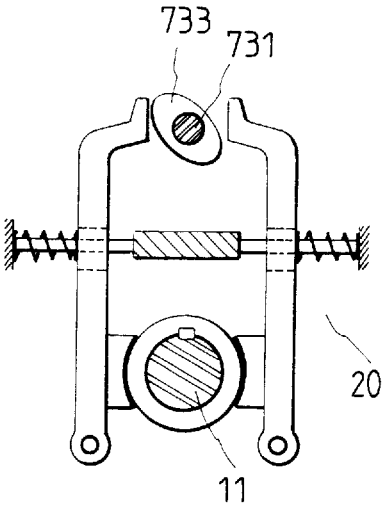
FIG. 12 is a schematic view showing that the cam works to open up the brake arm of the present invention.
Figure 13:
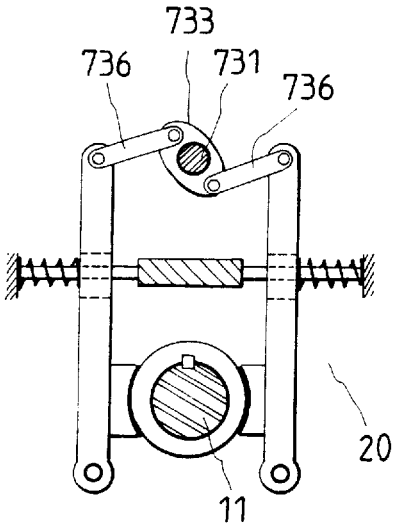
FIG. 13 is a schematic view showing that the cam of the fourth preferred embodiment of the present invention is provided with a connection rod for opening up the brake arm.
Figure 14:
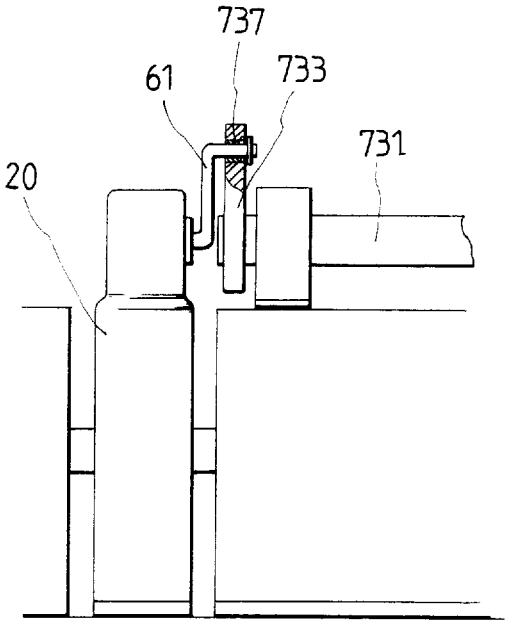
FIG. 14 is a schematic view showing that the cam of the fourth preferred embodiment of the present invention is provided with a through hole engageable with the action rod.

As shown in FIG. 9, the piston rod of the driven cylinder 712 is fastened at one end thereof with a driving rod 73 which is in turn fastened at another end thereof with a rotary rod 731 located on a bearing support seat 732 and the action rod 60. The driving rod 73 is provided with a cam 733 opposite to the action rod 60, as shown in FIG. 10. When the piston rod of the driven cylinder 712 is at work, or when the force applying cable 714 is pulled downwards, the rotary rod 731 is actuated by the driving rod 73 so as to cause the cam 733 to press the action rod 60, thereby result in the release of the braking action. The rotary rod 731 is provided with a wheel seat 734 fastened therewith eccentrically. As shown in FIG. 11, the wheel seat 734 is provided with an axle 735 parallel to the rotary rod 731. The transmission wheel 40 and the rotary wheel 41 are mounted on the axle 735. The action cable 50 is wound on the rotary wheel 41. When the rotary rod 731 is turned to release the braking action, the wheel seat 734 is caused to swing downwards, thereby causing the transmission wheel 40 to engage the action wheel 30 which is mounted on the shaft 11 of the motor 10. As a result, the elevator cab can be lifted or descended by the action cable 60. The cam 733 has two projections, as shown in FIG. 12. The cam 733 can be mounted between two brake arms of the brake 20. As the rotary rod 731 is turned, the cam 733 in motion is capable of pushing the brake arm outwards so as to cause the shaft 11 of the motor to be relieved of the braking action. As shown in FIG. 13, the cam 733 is provided with two eccentric connection rods 736. When the cam 733 is rotated, the brake arm is pushed outwards by the eccentric connection rods 736 to bring about the release of the braking action. As shown in FIG. 14, the cam 733 is provided with an eccentric through hole 737 which is engaged with one end of an action rod 61. As the rotary rod 731 is rotated, the action rod 61 is actuated by the cam 733 to swing so as to bring about the release of the braking action of the brake 20.

Figure 15:
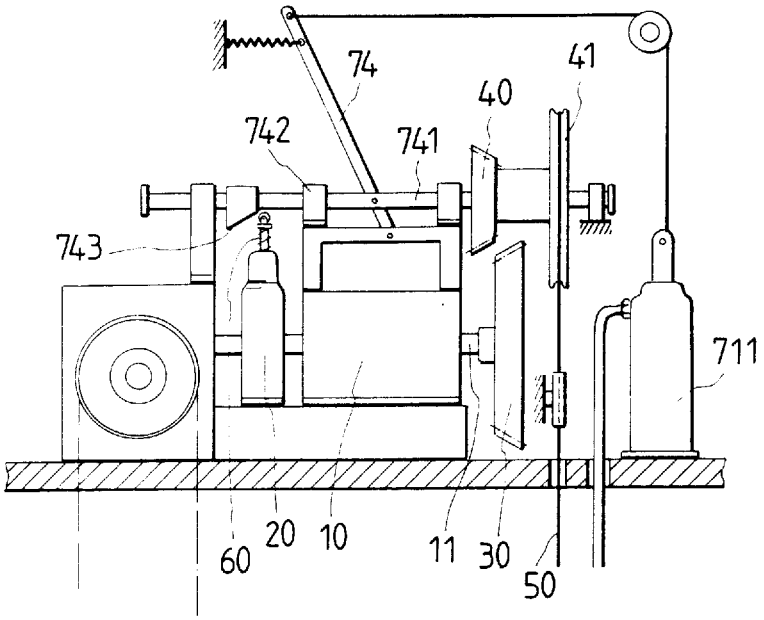
FIG. 15 shows a schematic view of a fifth preferred embodiment of the present invention.
Figure 16:
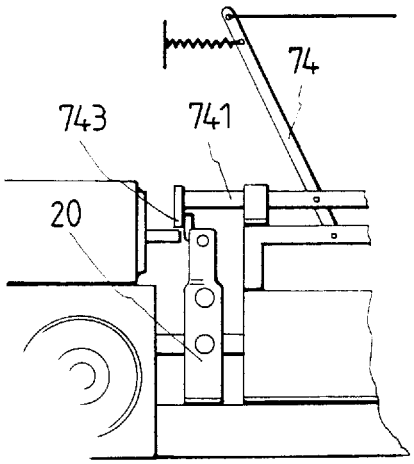
FIG. 16 is a schematic view showing that the crank of the fifth preferred embodiment of the present invention is at work to open up the brake arm.
Figure 18:
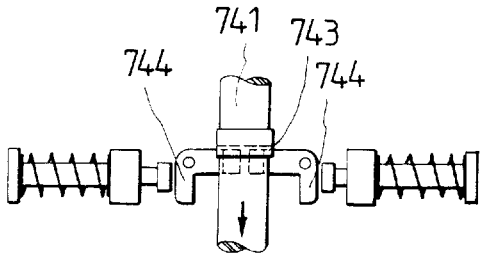
FIG. 18 is a sectional view of the fifth preferred embodiment of the present invention.
Figure 17:
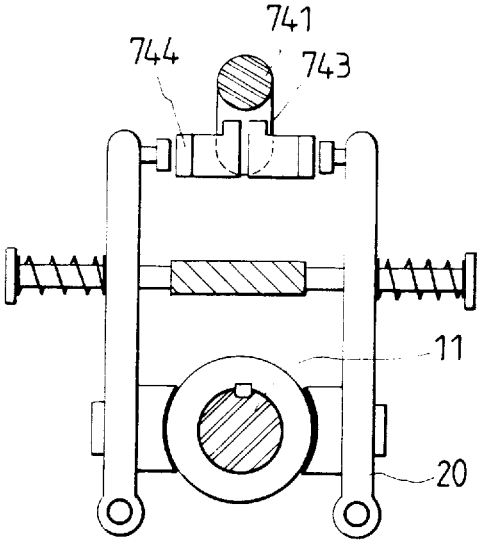
FIG. 17 is a top schematic view of the present invention as shown in FIG. 16.
Figure 19:
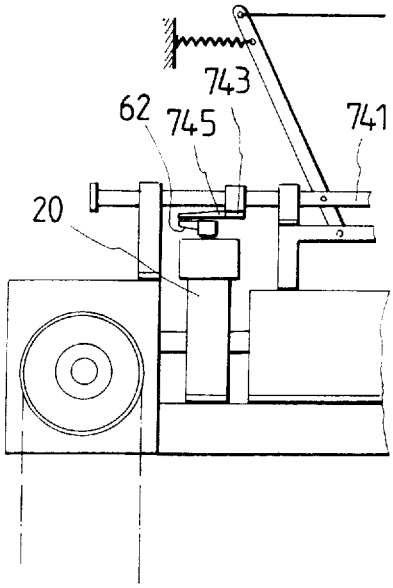
FIG. 19 is a schematic view showing that the pull rod of the fifth preferred embodiment of the present invention is at work to actuate the action rod to bring about the release of the braking action.
Figure 20:
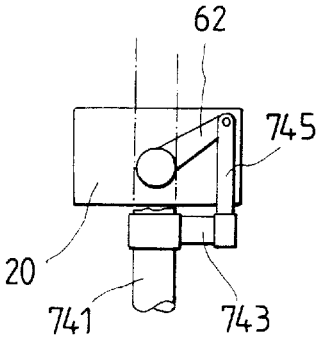
FIG. 20 show a top schematic view of a portion of the fifth referred embodiment of the present invention.

As shown in FIG. 15, the piston rod of the driven cylinder 712 (or the force applying cable 714) is fastened with a swing rod 74 which is in turn fastened at another end thereof with a moving rod 741 located by a support seat 742 such that the moving rod 741 is movably located on the action rod 60. The moving rod 741 is provided with a slanted projection 743. As the piston rod of the driven cylinder 712 is actuated, the moving rod 741 is driven by the swing rod 74 to move axially such that the slanted projection 743 of the moving rod 741 pushes the action rod 60 to move downwards so as to bring about the release of the braking action of the brake 20. The transmission wheel 40 and the rotary wheel 41 may be mounted on the moving rod 741. The action cable 50 is wound on the rotary wheel 41 so as to enable the transmission wheel 40 to displace axially when the moving rod 741 is caused to displace axially to bring about the release of the braking action. As a result, the transmission wheel 40 is engaged with the action wheel 30 mounted on the shaft 11 of the motor 10. The elevator cab can be thus moved up and down by pulling the action cable 50. The projection 743 of the moving rod 741 can be located between the two brake arms of the brake 20, as shown in FIG. 16. Located between the two brake arms are two movable cranks 744, as shown in FIGS. 17 and 18. The operation arms of the two cranks 744 are in contact with the projection 743. Under the normal operating condition, the operation arms of the two cranks 744 are urged by the urging rods of the electromagnetic device such that the cranks 744 are caused to swivel, and that another ends of the cranks 744 push the upper ends of the brake arms of the brake to move outwards so as to enable the shaft 11 of the motor 10 to be relieved of the braking action. When the moving rod 741 is displaced axially, the two cranks 744 are pushed by the projection 743 to swivel so as to push the brake arms outwards. As shown in FIGS. 19 and 20, the moving rod 741 is provided with a pull rod 745 fastened therewith such that the pull rod 745 is fastened at another end thereof with an action rod 62. As the moving rod 741 is displaced axially, the pull rod 745 is activated to actuate the action rod 62 to turn, thereby resulting in the release of the braking action of the brake 20.

As described above, the release of the braking action of the brake 20 can be brought about in various ways by the elevator cab passenger such that the elevator cab is manually operated to arrive at a safe floor where the trapped passengers can escape for safety.

Figure 21:
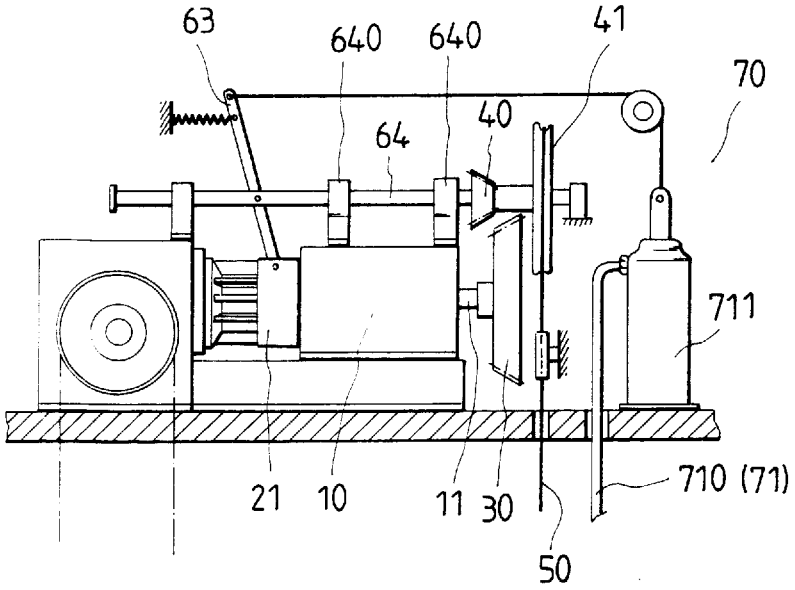
FIG. 21 shows a schematic view of a sixth preferred embodiment of the present invention.

As shown in FIG. 21, the shaft 11 of the motor 10 is provided with a disk brake 21 capable of being controlled by an action rod 63 which is provided at one end thereof with the force applying device 70 similar to the one described above. The force output member 71 of the force applying device 70 is a hydraulic (or air) pressure conveying tube 710, which has one end located in the elevator cab 2 in conjunction with the control tube of the elevator cab 2 such that the conveying tube 710 is connected with a hydraulic (or air) pressure control cylinder 711. The conveying tube 710 has another end which is connected with a driven cylinder 712 located in a mechanical control room 1. The piston rod of the control cylinder 711 is provided with an operation handle 713 capable of actuating the piston rod to bring about the transportation of the hydraulic (or air) pressure through the conveying tube 710 to the driven cylinder 712 in which the piston rod is actuated by the pressure. The release of the braking action of the disk brake 21 is brought about by the action rod 63 which is fastened with the piston rod of the driven cylinder 712 and is provided with a wheel rod 64 fastened therewith. The wheel rod 64 is located by a support seat 640 such that the transmission wheel 40 and the rotary wheel 41 are mounted on the wheel rod 64. The action cable 50 is wound on the rotary wheel 41 such that the axial displacement of the wheel rod 64 is brought about by the action rod 63 in motion, and that the transmission wheel 40 is engaged with the action wheel 30. As a result, the elevator cab 2 can be manually operated to move up and down by means of the action cable 50. The manual operation of the elevator cab 2 is brought about by a passenger located in the elevator cab 2. It must be noted here that the force output member 71 of the force applying device 70 may be a force applying cable or chain in place of the pressure conveying tube 710. The force applying cable or chain is fastened with the operation end of the action rod 63 such that the action rod 63 can be actuated by the force applying cable or chain to bring about the release of the braking action of the disk brake 21.

Figure 22:
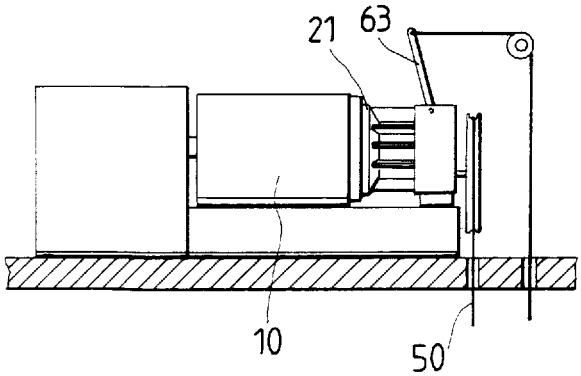
FIG. 22 shows a schematic view of a seventh preferred embodiment of the present invention.
Figure 23:
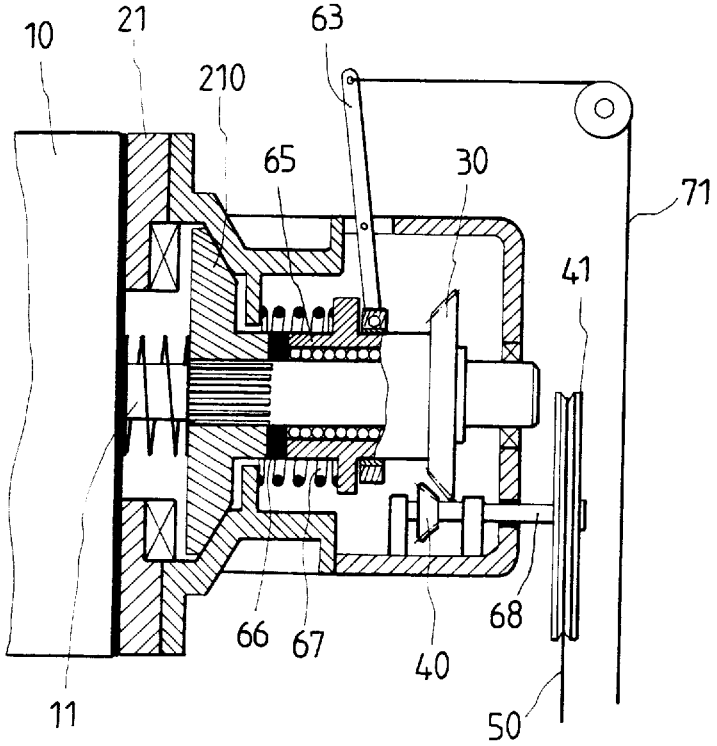
FIG. 23 is a schematic view showing the partial internal structure of the seventh preferred embodiment of the present invention.
Figure 24:
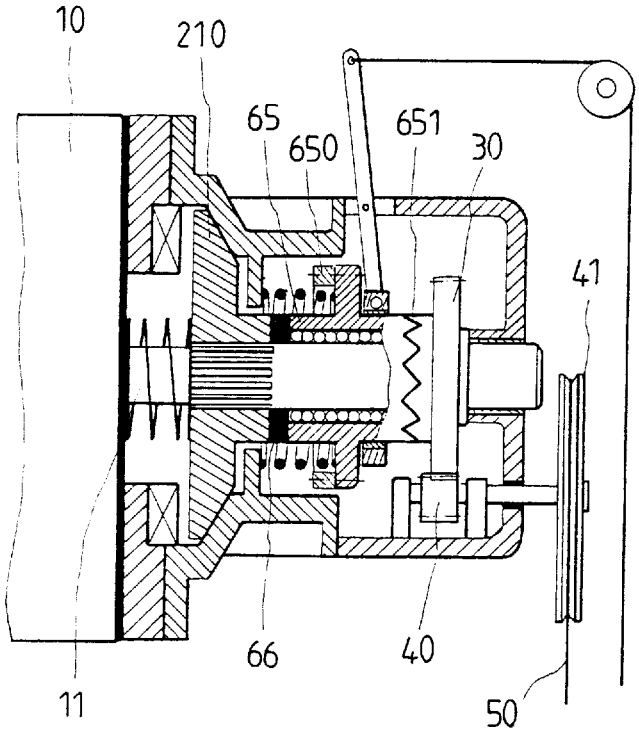
FIG. 24 is a schematic view showing that the seventh preferred embodiment of the present invention is provided with a speed-limiting centrifugal brake block.

As illustrated in FIG. 22, the control of the braking action of the disk brake 21 is brought about by the swinging motion of the action rod 63. Now referring to FIG. 23, the disk brake 21 may be mounted on another end of the shaft 11 of the motor 10 such that the disk brake 21 and the action wheel 30 are located on the same side, with the action wheel 30 being mounted on a shaft sleeve 65 capable of being actuated by the action rod 63. Located between the shaft sleeve 65 and the disk 210 of the disk brake 21 is a clutch 66, which is urged by a spring 67 to remain in the state of becoming engaged with the disk 210. The transmission wheel 40 and the rotary wheel 41 are mounted on an axle 68 parallel to the shaft 11 of the motor 10. The action cable 50 is wound on the rotary wheel 41 such that the shaft sleeve 65 is actuated by the action rod 63 to displace axially so as to force the disk 210 to move rearwards, thereby causing the shaft 11 to be free from the braking action. In the meantime, the axial displacement of the shaft sleeve 65 brings about the engagement of the action wheel 30 with the transmission wheel 40, thereby causing the action cable 50 to driven the shaft 11 of the motor 10 so as to move the elevator cab 2 up and down. In the event that the motor 10 is a high-speed one, the shaft sleeve 65 must be provided with a speed limiting centrifugal brake block 650. When the disk 210 mounted on the shaft 11 of the motor 10 is pushed rearwards by the shaft sleeve 65 to bring about the release of the braking action, the shaft sleeve 65 is actuated by the disk 210 to rotate in view of the inertia rotation of the shaft 11 of the motor 10. Under the normal operating condition, the act of clutching of the disk 210 is controlled by an electromagnetic device. As the clutch 66 is not in the state of being engaged, the shaft sleeve 65 can not be actuated by the disk 210 to rotate. The speed limiting centrifugal brake block 650 kicks in automatically to reduce the rotation speed of the shaft sleeve 65 when the rotation speed of the shaft sleeve 65 exceeds a certain limit. In the meantime, the rotation speed of the shaft 11 of the motor 10 is reduced to slow down the moving velocity of the elevator cab. As shown in FIG. 24, the shaft sleeve 65 and the action wheel 30 are linked by a ratchet 651. The action wheel 30 is directly engaged with the transmission wheel 40 which is driven by the rotary wheel 41 which is actuated by the pulling action of the action cable 50. The release of the braking action is attained by the axial displacement of the shaft sleeve 65.

The embodiments of the present invention described above are to be regarded in all respects as being merely illustrative and not restrictie. Accordingly, the present invention may be embodied in other specific forms without deviating from the spirit thereof. The present invention is therefore to be limited only by the scopes of the following appended claims.

What is claimed is:

1. An elevator emergency escape assembly comprising:

a brake mounted on a shaft of a motor located in a mechanical control room of an elevator, an action wheel mounted coaxially on said shaft of said motor, a transmission wheel that engages said action wheel, an action rod in communication with a force applying device, said force applying device comprising a force output member connected to a control cylinder located in an elevator, said force applying device is also in communication with a driven cylinder located in said mechanical control room, said control cylinder includes a piston rod with an operation handle to actuate said piston rod to transmit a fluid pressure through said force output member to regulate movement of a piston rod of said driven cylinder, thereby controlling movement of said action rod, and a rotary wheel connected to said transmission wheel and mounted on a force applying rod, said rotary wheel has a cable wound thereon; so that when said force output member is actuated, a braking action of said brake is released and said transmission wheel engages said action wheel, thereby enabling said elevator cab to move up and down as said action cable is pulled manually, said action cable causing said rotary wheel and said transmission wheel to rotate on said force applying rod, which rotation in turn causes said action wheel to rotate, thereby causing movement of said elevator cab.

2. The assembly as defined in claim 1, wherein:

said brake mounted on said shaft of said motor is a drum brake; and wherein movement of said force applying rod is controlled by said action rod, said action rod being in communication with said piston rod of said driven cylinder.

3. The assembly as defined in claim 2, wherein:

said cable wound on said rotary wheel is in communication with an idle wheel.

4. The assembly as defined in claim 2, wherein:

said force applying rod is urged by a spring in a direction opposite to the force exerted by said force applying device.

5. The assembly as defined in claim 2, wherein:

a weight is attached to an end of said force applying rod.

6. The assembly as defined in claim 1, wherein:

said motor is a high-speed motor without a speed changing gear, and said transmission wheel includes an axis provided with a speed-limiting friction wheel.

7. The assembly as defined in claim 1, wherein:

said piston rod of said driven cylinder is fastened to a driving rod which is fastened to a rotating rod located by a bearing support seat; and wherein action rod has a cam that is actuated by said driven cylinder such that said driving rod is linked with said rotary rod, and said action rod is driven by said cam.

8. The assembly as defined in claim 7, wherein:

said driving rod is fastened to said force applying cable and actuates said driving rod to drive said rotary rod.

9. The assembly as defined in claim 7, wherein:

said rotary rod is provided with a wheel seat fastened eccentrically thereto, said wheel seat having an axle parallel to said rotary rod and having a rotary wheel and a transmission wheel mounted thereon, said rotary wheel having an action cable wound thereon such that one end of said action cable is fastened to an idle wheel; such that said rotary rod is actuated to cause said wheel seat to swing so as to bring about the engagement of said transmission wheel with said action wheel mounted on said shaft of said motor.

10. The assembly as defined in claim 7, wherein:

said cam of said rotary rod is located between two brake arms of said drum brake.

11. The assembly as defined in claim 10, wherein:

said cam of said rotary rod is provided with two eccentric connection rods connected to said two brake arms.

12. The assembly as defined in claim 7, wherein:

said cam of said rotary rod is provided with an eccentric through hole; and said action rod is fastened to said eccentric through hole such that said action rod is driven by said rotary rod.

13. The assembly as defined in claim 1, wherein:

said piston rod of said driven cylinder is fastened to a swing rod which is fastened to a moving rod located by a support seat such that said moving rod is capable of an axial displacement on said action rod, said moving rod is provided with a cam actuated by said piston rod of said driven cylinder to push said action rod downward when said moving rod is actuated by said swing rod to displace axially.

14. The assembly as defined in claim 13, wherein:

said swing rod is actuated by said force applying cable to displace axially.

15. The assembly as defined in claim 13, wherein:

said moving rod is provided with a rotary wheel mounted thereon and a transmission wheel mounted thereon, said rotary wheel having an action cable wound thereon, said action cable is fastened to an idle wheel; and wherein said transmission wheel is engaged with said action wheel when said moving rod is displaced axially.

16. The assembly as defined in claim 13, wherein:

said cam of said moving rod is located between said two brake arms of said drum brake such that said cam is in contact with two cranks located between said two brake arms, and that said cam actuates said two cranks to push said two brake arms outward when said moving rod is displaced axially.

17. The assembly as defined in claim 13, wherein:

said cam of said moving rod is fastened to a pull rod which is fastened to said action rod such that said pull rod actuates said action rod when said moving rod is displaced axially.

18. The assembly as defined in claim 1, wherein:

said brake mounted on said shaft of said motor is a disk brake; and wherein said action rod is provided at one end thereof with a force applying device comprising a force output member which is a fluid pressure conveying tube having one end connected to said control cylinder located in said elevator cab, said pressure conveying tube having another end which is fastened to said driven cylinder located in said mechanical control room, said control cylinder having a piston rod provided with an operation handle capable of actuating said piston rod to regulate the conveying of said pressure to said driven cylinder, said driven cylinder having a piston rod which is fastened with said action rod such that said piston rod of said driven cylinder is capable of actuating said action rod to swing.

19. The assembly as defined in claim 18, wherein:

said force output member is a force applying cable means, a first end of said cable means is fastened to a tension weight located at the bottom of an elevator shaft, a second end of said cable means is fastened to an idle wheel and said action rod which is capable of being actuated by said force applying cable which can be pulled via a window of an elevator cab.

20. The assembly as defined in claim 18, wherein:

said action rod is fastened to an axle on which a rotary wheel and a transmission wheel are mounted such that said rotary wheel is linked with said transmission wheel, said rotary wheel having an action cable wound thereon such that said action cable is fastened to an idle wheel, and that said transmission wheel is caused to engage said action wheel when said axle is actuated by said action rod to displace axially.

21. The assembly as defined in claim 18, wherein:

said brake and said action rod are mounted on the same side of said shaft of said motor; wherein said action wheel is mounted on a shaft sleeve that is actuated by said action rod, said shaft sleeve and a disk of said brake are provided therebetween with a clutch urged by a spring; wherein said axle is parallel to said shaft of said motor and is provided with a rotary wheel mounted thereon and a transmission wheel mounted thereon such that said transmission wheel is linked with said rotary wheel which is provided with an action cable wound thereon such that said action cable is fastened to an idle wheel and so that said action wheel is engaged with said transmission wheel when said shaft sleeve is actuated by said action rod to displace axially.

22. The assembly as defined in claim 18, wherein:

said brake is mounted on said shaft of said motor; wherein said shaft sleeve is mounted on said shaft of said motor such that said shaft sleeve and said disk of said brake are provided therebetween with a clutch urged by a spring; wherein said shaft sleeve is actuated by said action rod to displace axially to cause said disk of said brake to release a braking action; wherein said shaft sleeve has a speed-limiting friction wheel capable of reducing the rotation speed of said shaft of said motor by an inertia action of said weight when said elevator cab is relieved of said braking action.

23. The assembly as defined in claim 22, wherein:

said shaft of said motor is provided coaxially with a shaft sleeve mounted thereon, an action wheel mounted thereon, and a ratchet located between said shaft sleeve and said action wheel; wherein said action wheel is engaged with a transmission wheel which is mounted on an axle on which a rotary wheel is mounted such that an action cable is wound on said rotary wheel, and that said action cable is fastened to an idle wheel, and that said action wheel is actuated by said action cable to enable said ratchet to cause said shaft sleeve to displace axially.

* * * * *